US010260118B2

(12) United States Patent
Steffens et al.

(10) Patent No.: US 10,260,118 B2
(45) Date of Patent: Apr. 16, 2019

(54) POST-TREATING A HARDENED METAL FORMED PART

(71) Applicant: Muhr und Bender KG, Attendorn (DE)

(72) Inventors: Hubertus Steffens, Drolshagen (DE); Christoph Hahn, Attendorn (DE); Benedikt Goddeke, Schmallenberg (DE)

(73) Assignee: Muhr und Bender KG, Attendorn (DE)

( * ) Notice: Subject to any disclaimer, the term of this patent is extended or adjusted under 35 U.S.C. 154(b) by 660 days.

(21) Appl. No.: 14/559,241

(22) Filed: Dec. 3, 2014

(65) Prior Publication Data

US 2015/0159234 A1 Jun. 11, 2015

(30) Foreign Application Priority Data

Dec. 10, 2013 (DE) ..... 10 2013 225 409

(51) Int. Cl.
*C21D 1/40* (2006.01)
*C21D 8/02* (2006.01)
(Continued)

(52) U.S. Cl.
CPC ..... *C21D 1/40* (2013.01); *C21D 8/0294* (2013.01); *C21D 8/0494* (2013.01); *C21D 9/48* (2013.01);
(Continued)

(58) Field of Classification Search
CPC .... C21D 1/40; C21D 2221/00; C21D 8/0294; C21D 9/48; H05B 3/0004
(Continued)

(56) References Cited

U.S. PATENT DOCUMENTS 5,916,389 A 6/1999 Lundstrom
5,972,134 A 10/1999 Buschsieweke et al.
(Continued)

FOREIGN PATENT DOCUMENTS

DE 877179 C 5/1953
DE 19723655 A1 12/1997
(Continued)

OTHER PUBLICATIONS

NPL: Machine translation of JP 2011136342 A, Jul. 2011.*

*Primary Examiner* — Jie Yang
(74) *Attorney, Agent, or Firm* — Bejin Bieneman PLC

(57) ABSTRACT

A formed and hardened component made from a metallic material is post-treated by a device for electric resistance heating that has at least one first pair of contact pieces and at least one second pair of contact pieces; contacting a first partial region of the component with the contact pieces of the first pair such that the first partial region is arranged between the contact pieces of the first pair; contacting the second partial region of the component with the contact pieces of the second pair such that the second partial region is arranged between the contact pieces of the second pair; heating of the first partial region of the component to a first temperature by conducting electric current through the component by the first pair of contact pieces; setting the second partial region of the component to a second temperature by the second pair of contact pieces, which is set independently of the first temperature.

11 Claims, 3 Drawing Sheets

Figure 2:
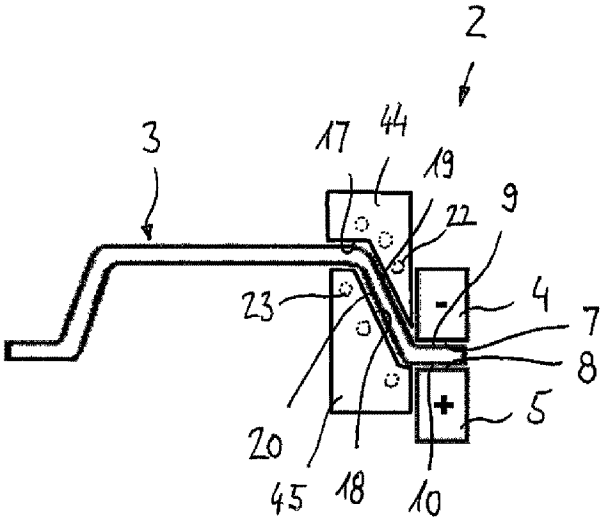

(51) Int. Cl.
*C21D 8/04* (2006.01)
*C21D 9/48* (2006.01)
*H05B 3/00* (2006.01)

(52) U.S. Cl.
CPC ..... *H05B 3/0004* (2013.01); *C21D 2221/00* (2013.01)

(58) Field of Classification Search
USPC ..... 148/566
See application file for complete search history.

(56) References Cited

U.S. PATENT DOCUMENTS 6,903,296 B2 6/2005 Gomez
7,461,874 B2 * 12/2008 Guiles ..... B60R 19/18 29/897.2
8,657,970 B2 * 2/2014 Yoshinaga ..... C21D 8/0426 148/320
2011/0315281 A1 12/2011 Charest et al.
2012/0023748 A1 2/2012 Pohl et al.
2013/0136945 A1 5/2013 Charest et al.
2013/0283881 A1 * 10/2013 Hauger ..... B21B 37/74 72/201
2014/0124104 A1 5/2014 Trippe et al.

FOREIGN PATENT DOCUMENTS

DE 19743802 A1 3/1999
DE 10212819 A1 10/2003
DE 102011078075 A1 3/2012
DE 102010004823 B4 5/2013
DE 102012110649 B3 11/2013
JP H10158728 A 6/1998
JP H10280054 A 10/1998
JP 2011136342 A * 7/2011

* cited by examiner

POST-TREATING A HARDENED METAL FORMED PART

CROSS-REFERENCE TO RELATED APPLICATIONS

This application claims priority to German Application No. DE 10 2013 225 409.1 filed Dec. 10, 2013, the entire contents of which prior application is incorporated herein by reference.

BACKGROUND

From DE 10 201 0 004 823 B4 a method is known for manufacturing a metallic moulded component for motor vehicle components, which has zones of higher ductility. For this a blank, made form a steel alloy, is heated to a temperature between 900° C. and 950° C., then it is formed in a pressing tool to the formed component and heat treated. After the heat treatment the formed component is partially soft-annealed, wherein the heating process during the soft-annealing is conductively carried out within a time period of less than 30 seconds.

From DE 10 2011 078 075 A1 a method is known for forming a product with the following steps: carrying out a heat treatment and press hardening process for forming a product with an evenly distributed first tensile strength; carrying out a heat treatment post-processing by selective heating of a first portion above a defined temperature between 400° C. and 700° C., while at the same time a second portion is held below the defined temperature; and following cooling of the first portion such that it obtains a tensile strength that is lower than the first tensile strength of the press hardened product. For the heat treatment post-processing of the first portion it is proposed to use a conductive heating process.

From DE 197 23 655 A1 a method is known for manufacturing a steel sheet product by means of heating a cut steel sheet, hot forming of the steel sheet in a tool pair and hardening the formed product by means of quick cooling starting from the austenitic temperature in the tool pair. During the hardening of the product, partial regions remain unhardened because of the fact that in these partial regions a quick cooling is prevented.

From DE 197 43 802 A1 a method is known for manufacturing a metallic moulded component, which has areas with increased ductility compared to the rest of the component. For this, the partial regions of the blank are heated in a time of less than 30 seconds to a temperature between 600° C. and 900° C. Then, the heat-treated blank is deformed in a pressing tool to the moulded component and is then annealed in the pressing tool.

SUMMARY

A method and a device are disclosed herein for post-treating a hardened metal formed part. Such hardened metal formed parts can for example be manufactured from sheet blanks, which are subsequently hot-formed or press-hardened, respectively.

The method for post-treating a metal formed part makes it possible to easily produce regions of different material characteristics, like ductility or strength, at the formed part. The device enables a partial setting of different material characteristics at a metallic formed part with high accuracy.

A method for post-treating a formed and hardened component made of a metallic material by a device for electric resistance heating, which has at least a first pair of contact pieces and at least one second pair of contact pieces, comprises the following steps:

contacting the contact pieces of the first pair with a to be heated first partial region of the component such that the to be heated first partial region is arranged between the contact pieces of the first pair;

contacting the contact pieces of the second pair with a second partial region of the component such that the second partial region is arranged between the contact pieces of the second pair;

heating the first partial region of the component to a first temperature (T1) by conducting electric current through the component by the first pair of contact pieces; setting the second partial region of the component to a second temperature (T2) by the second pair of contact pieces, wherein the second temperature (T2) is set independently of the first temperature (T1).

An advantage is that the hardened component can be softened in a targeted manner in partial regions to achieve a higher ductility in said areas, whereby for example subsequent working processes can be simplified. By using several pairs of contact pieces, the ductility of the component can be adjusted in different partial regions in a targeted manner to the individual requirements. It is for example possible to soften the first partial region by heating to a higher first temperature, while a neighbouring second partial region is cooled at the same time to a second temperature and thus maintains a higher hardness. However, it is also possible, by setting the first and the second temperature correspondingly, to achieve in both partial regions a softening compared to the overall hardened condition, however to a different extent. According to an embodiment, the first pair of contact pieces and the second pair of contact pieces can be individually controlled concerning at least one parameter influencing the temperature of the contact pieces. For example, in the first pair of contact pieces the electric current can be controlled, while in the second pair the temperature of a cooling medium can be controlled. The contact pieces according to the present disclosure are supposed to have a form which is adapted to the form of the component to be treated. The contact pieces can thus also be referred to as form contact pieces or mould contact pieces.

A hardened metal component is meant in the context of this disclosure to include any metal component that is formed in a forming process and hardened at least in partial regions of the formed metal component, or completely hardened. The component can have partial regions with different sheet thicknesses, which, for example, may be manufactured by flexible rolling of strip material, or by connecting several components of different sheet thickness to each other. Blanks with different sheet thicknesses, produced by flexible rolling, are also referred to as Tailor Rolled Blanks. Blanks that are composed of several partial blanks with different sheet thickness and welded to each other are also called Tailor Welded Blanks. In principle, the component can also be composed of different materials. However, it may have at least one metal partial region, which is formed by a metal forming process. The component can also be called a formed part. The term formed part thus refers to a part being formed to have a three-dimensional shape. The formed part, respectively component, can be used for example as a structural component of a motor vehicle.

The first pair of contact pieces and the second pair of contact pieces can be arranged directly next to each other; respectively, they can be brought into contact directly next to each other with the component. It is thus achieved in an advantageous manner that a transition area between a softened first partial region and an adjacent second partial region, which may have different material properties than the first partial region, is small. The component is securely held between the contact pieces and defined partial regions can be heat treated in a targeted manner. A softened partial region can be limited to a defined area by cooling a partial region, arranged directly next thereto. In this case, the contact pieces, used for cooling, have a thermal insulating effect, so that the component properties are only changed in the first partial region. Depending on the embodiment or the function, the contact pieces can also be characterised as form electrodes or as form jaws.

The at least one first pair of contact pieces is formed for post-treating the component by conductive heating. In this case, "at least one first pair" means that also several first pairs of contact pieces can be provided for conductively heating partial regions of the component. During the conductive heating, the metal component forms a part of the electric circuit. In this case, an area of the component, contacting the contact pieces, forms a passage for the electric current. Because of the electric resistance a heating of the component is achieved in the region through which electric current flows, because of which this method is also characterised as resistance heating.

According to an embodiment, the first partial region is heated to a first temperature, which is at least 200° C., preferably at least 500° C., especially at least 700° C., and/or at a maximum 900° C. The higher the temperature is selected for heating the first partial region, the shorter the exposure time can be, at which the component has to be heated, to achieve the required softening. According to an embodiment, the first partial region is heated over a time period of at least 30 seconds. Thus, an unwanted formation of distortions due to hardening can be reduced or completely prevented. The following relations between the heating temperatures and the respective heating exposure time for softening the first partial region can be used for up to 700° C. treating temperature at least 5 minutes exposure time; for up to 750° C. heating temperature at least 2.5 minutes exposure time; for up to 800° C. heating temperature at least 1.25 minutes exposure time; and above 850° C. at least 30 seconds exposure time.

The at least one second pair of contact pieces serves for setting the second temperature for the at least one respective second partial region of the component to be different than the first partial region, wherein the step of setting of the second temperature can be a heating or a cooling process.

According to a first possibility the step of setting the temperature of the second partial region of the component is a heating process, which is achieved by transmitting electric current from one of the contact pieces through the component to the other of the contact pieces. In this case, the current flow for the second pair can be individually controlled, i.e., independent of the first pair of contact pieces. For example, a lower or higher electric energy can be introduced into the component in the second partial region, so that the geometric features such as smaller or larger sheet thickness of the second partial region can be taken into account.

For the step of heating at least one of the following can be applied: the first partial region and the second partial region of the component are heated such that electric current is conducted between the first pair of contact pieces and the second pair of contact pieces through the component at least partially with a timely offset; and/or that electric current is conducted between the first pair of contact pieces and of the second pair of contact pieces through the component at least partially with a timely overlap; and/or that the first partial region and the second partial region of the component are heated such, that electric current with different current ratings is transmitted between the first pair of contact pieces and the second pair of contact pieces. The contact pieces of the first, second and any potential further pair are configured as form electrodes. However, said contact pieces can also be formed as respective segments of one single electrode, wherein in this case the individual segments are individually controllable. At least with a partial timely offset is meant to include that the starting time for conducting current through the first pair is different, i.e., timely offset, from the starting time for conducting current through the second pair. The expression with a timely overlap is supposed to include that there is a time at which both pairs, i. e. the first pair and the second pair, conduct electric current through the component.

According to a second possibility the step of setting the second partial region of the component to a second temperature is a cooling process, which is carried out by cooling the contact pieces of the second pair. For this, the contact pieces of the second pair can for example be formed as cooling members, which are cooled by a suitable mechanism like an integrated cooling circuit. By bringing the cooling members into contact with the second partial region of the component, the latter is cooled, so that here no or only a small softening is achieved.

For arranging the first and the second pair of contact pieces on the component, generally different alternatives can be considered. The hardened component can be a formed part made from steel sheet, which has a thickness that is much less, e.g., less than half of an extension in longitudinal or transversal direction of the component. For example boron steel 22MnB5, such as is known, can be used as steel material, but any other hardenable steel material can also be considered.

According to a first embodiment, the component is arranged between the contact pieces such that the contact pieces of one pair are arranged opposite to each other in a thickness direction of the component. This arrangement can be valid for the first pair and/or the second pair of contact pieces. A first contact piece of one pair is brought into contact with a lower side of the component, while an opposite second contact piece is brought into contact with the upper side of the component. In this manner the component is held or clamped, respectively, between the contact pieces. This has the specific advantage that an unwished distortion of the component during the post-treatment is prevented. The function faces of the contact pieces, which are in contact with the component during heating, are adapted concerning their geometry to the shape of the component. The contact pieces of the first pair, which are used for the conductive heating, have thus two functions, namely to introduce electric current into the component and, secondly, fixing the component between the contact faces. The contact pieces of the second pair can, depending on the embodiment, have one or two functions, depending on whether they only serve for cooling or also for conductive heating.

For the step of bringing into contact the contact pieces of the first and/or of the second pair with the component, at least one of the following applies for the arrangement in thickness direction: an upper contact piece of the first pair and an upper piece of the second pair are brought into contact with the component at the same time; and/or a lower contact piece of the first pair and a lower piece of the second pair are brought into contact with the component at the same.

According to a second embodiment, the component is arranged between the contact pieces such that the contact pieces of one pair are arranged opposite to each other in a transversal direction of the component. This arrangement again can be valid for the first pair and/or second pair of contact pieces. In components made from flexible rolled strip material it is especially advantageous when both electrodes of one pair, i.e., the positive poled electrode and the negative poled electrode, are both arranged in a thickness portion with constant thickness in transversal direction. In this manner a constant heating of this partial region is achieved. A first contact piece of the pair is brought into contact with a first edge portion of the component, while the second contact piece is brought into contact with the opposite second edge portion of the component. By introducing an electric current the first partial region, extending in transversal direction between the two edge portions, is heated. The contact pieces according to this embodiment can be formed as gripping jaws or gripping tongs, which are clamped to the respective edge portion of the component.

Before the post-treatment at least one of the following steps can be provided: flexible rolling of strip material; cutting a blank from a flexible rolled strip material, wherein the blank has a variable thickness across the length; hot-forming a blank to a component; complete hardening of the component; cleaning of the component; and/or scaling of the component. It is obvious, that further method steps may be applied as previous, subsequent or also as intermediate steps.

The above object can be further achieved by a device for post-treating a formed and hardened component made from a metallic material, comprising: at least one first pair of contact pieces that are configured as form electrodes for passing electric current through a first partial region of the component, wherein contact faces of the contact pieces are adapted to outer faces of the first partial region, wherein the first partial region of the component is heatable to a first temperature by conducting electric current through the first partial region; at least one second pair of contact pieces for setting a second partial region of the component to a second temperature, wherein the contact faces of the second pair of contact pieces are adapted to outer faces of the second partial region, wherein a temperature setting mechanism is provided, that is configured to set the second pair of contact pieces to a second temperature, which differs from the first temperature.

By means of this device the same advantages can be achieved, as described in connection with the method disclosed herein, so that it is here referred to the above description for abbreviation. In this case it is to be understood that all named embodiments of the method are transferrable to the device and vice versa. According to a possible further embodiment, the second partial region of the component can be arranged next to the first partial region and correspondingly, the second pair of contact pieces can be arranged next to the first pair of contact pieces. It will be understood that the device can have, in addition to the first and second pair of contact pieces, also further pairs of contact pieces to produce a softening or a higher ductility in other partial regions of the component in a targeted manner. The device offers thus a high flexibility to adjust different zones of the component if necessary to defined material characteristics. This is especially valid for such zones, which are to be further processed at a later stage, for example by welding or drilling for being connected to other components.

As stated above, according to a first possibility the contact pieces of the second pair can be configured as form electrodes for passing electric current through the second partial region of the component. In this case, an electronic control unit can be provided that is configured to control the electric current through the electrodes of the first pair and through the electrodes of the second pair individually with respect to at least one parameter influencing the heating of the component.

According to a second possibility, the contact pieces of the second pair can be formed as cooling contact pieces that are configured to adjust the second partial region to a second temperature below the first temperature. For this, the cooling contact pieces can have a cooling mechanism such as integrated cooling circuits, through which a cooling medium, like water or steam, can flow.

According to an embodiment, a movement mechanism can be provided that is configured to move at least the contact pieces of the first pair towards each other to contact an upper and a lower outer face of the component. This mechanism can be provided in the form of a feed device or a drive with which the contact pieces of a respective pair are moveable relative to each other. This includes as possibilities, that a contact piece is arranged stationary and another contact piece is moved relative thereto, or that both contact pieces are moved towards each other at the same time.

Furthermore, the movement mechanism can be configured to move several neighbouring contact pieces together to contact an outer face of the component. For example, a contact piece of a first pair and a contact piece of a second pair can be arranged directly next to each other and can be accommodated in one common tool. By moving the tool, the contact pieces accommodated therein are jointly moved, which has the advantage that said jointly accommodated contact pieces contact the component at the same time and there develop their tempering and shape maintaining function.

More particularly, lower contact pieces can be provided in a lower tool part, onto which the component is set. Corresponding upper contact pieces that interact with the lower contact pieces can be arranged in an upper tool part that is movable relative to the lower tool part. By moving the upper tool part towards the lower, the component is clamped between the lower and upper contact pieces so that it keeps its shape during heating.

According to an embodiment the first contact piece of the first pair has a form face that is adapted to a first upper face of the component and the opposite second contact piece has a second form face, which is adapted to the opposite second surface of the component. This is will be understood to be valid in the same manner also for the contact pieces of the second and any further pair. By this embodiment, a secure fixing of the component between the contact pieces is achieved with any component geometry. In particular, for components having a variable sheet thickness across the length or width of the component, the contact pieces can be correspondingly adapted, so that a constant heating or cooling of the respective partial region is ensured. The form face of a respective contact piece is adapted to the geometry of the component. It can also be referred to as contact face or mould face.

The contact pieces of the first and/or second pair, configured as form electrodes, have respectively one contact face, which is smaller than 400 $mm^2$ (four-hundred square millimeters). Thus, a good current introduction into the component and a good adaptation to the component geometry is achieved.

Figure 1:
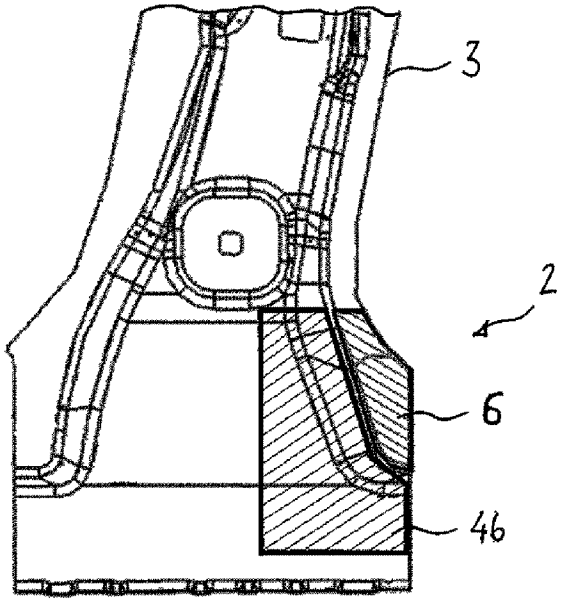
Figure 5:
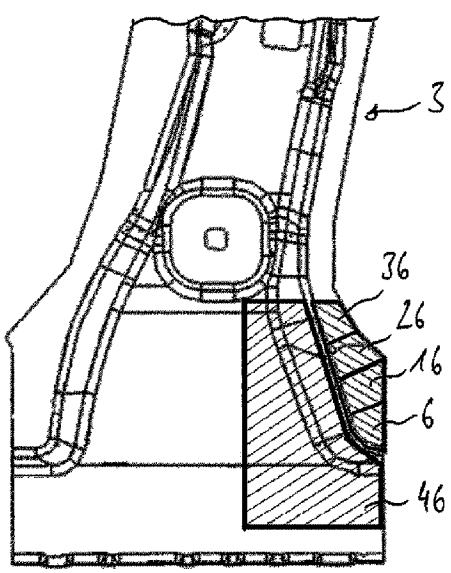
Figure 6:
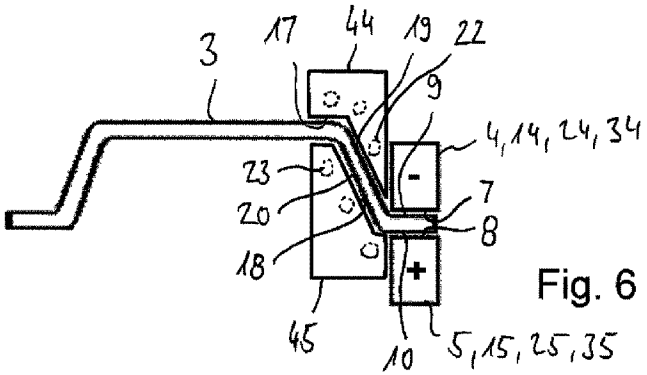
Figure 3:
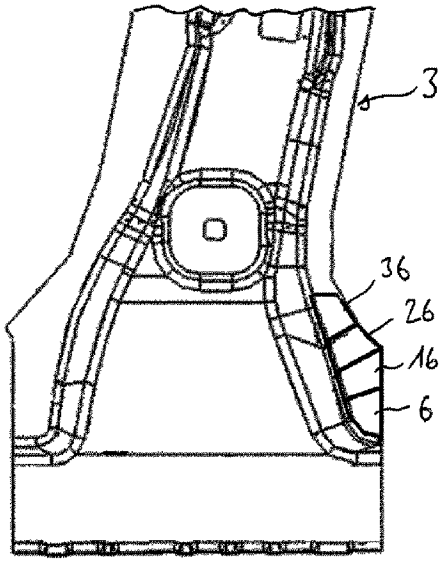
Figure 4:
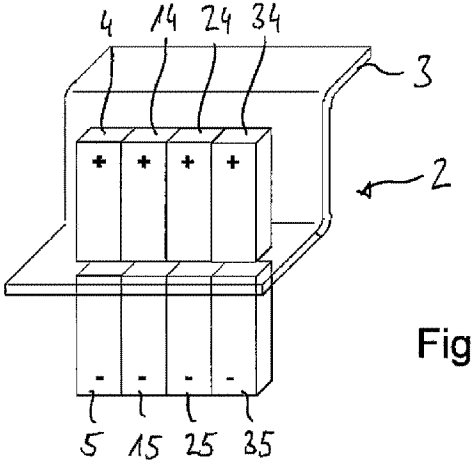
Figure 10:
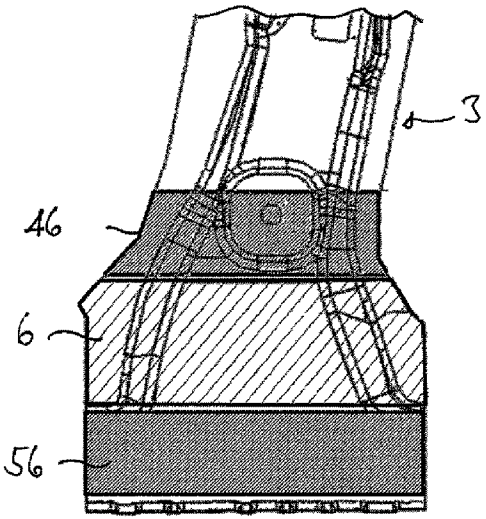
Figure 9:
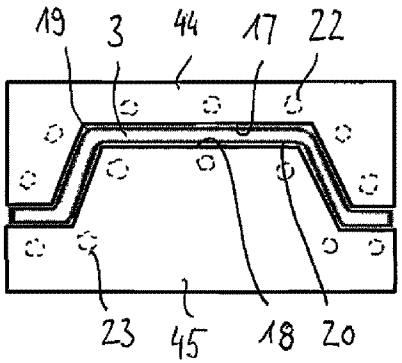
Figure 7:
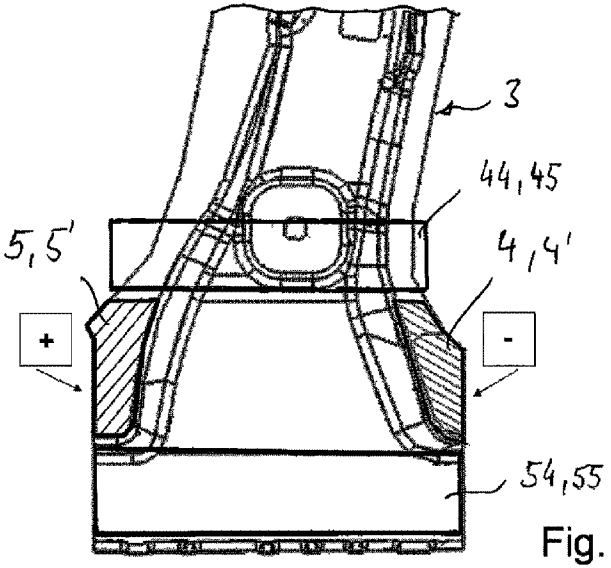
Figure 8:
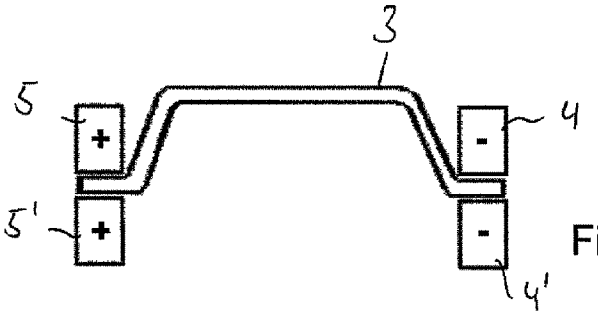

Example embodiments are described in the following using the drawings, which show:

FIG. 1; a formed and hardened metal component for post-treating partial regions in a top view, FIG. 2; a device in a first embodiment for post-treating the component of FIG. 1, in cross-section, FIG. 3; a formed and hardened metal component for post-treating partial regions in a top view, FIG. 4: a device in a second embodiment for post-treating the component of FIG. 3, schematically in a perspective view, FIG. 5: a formed and hardened metal component for post-treating partial regions in a top view, FIG. 6: a device in a further embodiment for post-treating the component of FIG. 5, in a cross-section, FIG. 7: a device for post-treating partial regions of a formed and hardened component in a further embodiment in a top view, FIG. 8: the device of FIG. 7 in a cross-sectional view through a first pair of contact pieces, FIG. 9: the device of FIG. 7 in a cross-sectional view through a second pair of contact pieces, and FIG. 10: the component of FIG. 7 with post-treated partial regions in a top view.

FIGS. 1 and 2, which are described jointly below, show a device 2 for post-treating a formed and hardened component 3, which is manufactured from a metallic material, in a first embodiment.

The device 2 comprises a first pair of contact pieces 4, 5 that are configured as form electrodes for transmitting an electric current through a first partial region 6 of the component 3. The contact faces 7, 8 of the contact pieces 4, 5, which can also be referred to as function faces, are adapted to outer faces 9, 10 of the first partial region 6. This means that the geometry of the contact faces 7, 8 is formed corresponding to the geometry of the first partial region 6, wherein especially also different sheet thicknesses of the component can be considered by shaping of the contact pieces accordingly. The form electrodes 4, 5 are brought into surface contact with the component 3, which is clamped between an upper and a lower form electrode 4, 5. By closing the electric circuit between the two form electrodes 4, 5 an electric current is passed through the first partial region 6, so that this partial region 6 is heated to a first temperature T1 because of the electric resistance. The first partial region 6 is shown hatched in FIG. 1. In a top view, the contact pieces 4, 5 have a contact face that is formed correspondingly to the outline of the first area 6.

A special feature of the present embodiment is that the component 3 is arranged between the two contact pieces 4, 5 in a thickness direction thereof. A lower contact piece 5 is brought into contact with the lower side of the component 3, while an upper contact piece 4 is brought into contact with the upper side of the component. Thus, the component 3 is held or clamped between the contact pieces 4, 5. An unwished distortion because of heating the component can thus be prevented. The contact faces 7, 8 of the contact pieces 4, 5 of the first pair are preferably smaller than 400 $mm^2$ for a good current introduction, wherein in principle also larger faces are possible. In the present embodiment the electric current flows substantially vertically relative to the contact faces 7, 8, i.e., substantially in a thickness direction of the component 3. Thus, a quick heating is achieved.

Preferably, the first partial region 6 is heated to a first temperature T1, which is at least 500° C., preferably at least 700° C. The upper limit for the first temperature T1 can be, for example, 900° C. The higher the temperature T1 is selected for heating the first partial region 6, the shorter the exposure time can be selected at which the component has to be heated to achieve the required softening. Preferably, the first partial region 6 is heated for a period of at least 30 seconds, thus reducing the production of unwished hardening distortions. Concerning the relation between heating temperatures and respective heating exposure times for softening the first partial region, the following embodiments can be used, not being limited thereto: at up to 700° C. heating temperature at least 5 minutes exposure time, at up to 750° C. at least 2.5 minutes exposure time, at up to 800° C. at least 1.25 minutes exposure time and at above 850° C. at least 30 seconds exposure time.

The device 2 further comprises a second pair of contact pieces 44, 45 for setting a second partial region 46 of the component 3 to a second temperature T2. Also for the second pair it applies that the contact faces 17, 18 of the contact pieces 44, 45 are correspondingly adapted to the outer faces 19, 20 of the second partial region 46. The contact pieces 44, 45 of the second pair are presently formed as cooling contact pieces, with which the second partial region 46 is adjustable to a temperature T2 below the temperature T1. For this, the cooling contact pieces 44, 45 have a temperature setting mechanism that can comprise integrated cooling circuits 22, 23 (represented in a dashed line), through which a cooling medium, like water or steam, can be passed. By this design, i.e., providing cooling contact pieces 44, 45, it is achieved that the heat introduced into the component 3 by the electrodes 4, 5 remains spatially limited to the first partial region 6 and leads to a softening only there, while the second partial region 46 keeps its initial strength because of the cooling. For cooling, the contact pieces 44, 45 of the second pair can be adjusted to a temperature T2 of below 300° C., in particular to below 200° C. or even less than 100° C.

The contact pieces of the first pair 4, 5, respectively of the second pair 44, 45 are made from high-strength, temperature resistant material. Concerning the shape and the size they are adapted, as described above, to the to be heated or cooled partial regions of the component. By arranging the first contact pieces 4, 5 for heating and second contact pieces 44, 45 for cooling adjacent to each other, a short transition region is achieved in an advantageous manner between the softened first partial region 6 and the untreated second partial region 46. The contact pieces 4, 5, loaded with electric current, can be cooled for increasing the durability.

The device can be provided in two part form and can comprise a lower tool part, in which respectively a first contact piece 5, 45 of the first and the second pair are arranged, as well as an upper tool part, in which respectively the corresponding second contact piece 4, 44 of the first and the second pair are arranged. By moving the upper tool part in direction towards the lower tool part or vice versa, the component 3 is clamped between the lower and upper contact pieces 5, 45; 4, 44. For moving the tool part, a suitable mechanism can be provided.

FIGS. 3 and 4, which are jointly described below, show a device according to the invention in a second embodiment. This largely corresponds concerning its design and function to that according to FIGS. 1 and 2, so that concerning the commonalities reference is made to the above description. In this case, the same or one another corresponding details are provided with the same reference numeral as in FIGS. 1 and 2.

A special feature of the present embodiment according to FIGS. 3 and 4 is, that four pairs of contact pieces are provided, wherein it will be understood that also a different number of two, three, five or more pairs can be used. The contact pieces of each pair 4, 5; 14, 15; 24, 25; 34, 35 are configured as form electrodes, with which electric current can be transmitted through the component 3. In this case, a first partial region 6 is heated by the first pair 4, 5, a second partial region 16 is heated by the second pair 14, 15, a third partial region 26 is heated by the third pair 24, 25 and a fourth partial region 36 is heated by the fourth pair 34, 35.

The pairs of contact pieces can be controlled individually with respect to one or more parameters influencing the degree of heating, for example, concerning the amperage or the exposure time. In this manner, the different partial regions 6, 16, 26, 36 can be individually heated. In this case, it is especially possible to consider sheet thickness differences of the partial regions such that overall a targeted heating and thus also a defined softening is achieved.

The first pair of electrodes 4, 5 can be heated to a first temperature T1, while the second pair of electrodes 14, 15 can be heated up to a second temperature T2, deviating therefrom. Also the third and the fourth pair of electrodes 24, 25; 34, 35 can be individually controlled concerning the required temperature, and can be adjusted to one of the temperatures T1 or T2 or to temperatures deviating therefrom.

Incidentally, all features that have been described in connection with the embodiment of FIGS. 1 and 2 for the first pair are likewise valid for each of the four pairs of the present embodiment according to FIGS. 3 and 4. With respect to these features reference is made to the above description.

FIGS. 5 and 6, which are jointly described together below, show a device according to the invention in a third embodiment. This corresponds concerning its design and function to a combination of the embodiments of FIGS. 1 and 2 with that according to FIGS. 3 and 4, so that concerning the commonalities reference is made to the above description. In this case, the same or one another corresponding details are provided with the same reference numerals as in FIGS. 1 to 4.

A special feature of the present embodiment according to FIGS. 5 and 6 is that it has four pairs of contact pieces 4, 5; 14, 15; 24, 25; 34, 35, configured as electrodes for heating, respectively softening the partial regions 6, 16, 26, 36. What has been described in connection with the description of FIGS. 3 and 4 is likewise valid. Additionally, a pair of contact pieces 44, 45 is provided, which are configured as cooling contact pieces, i.e., corresponding to the cooling contact pieces 44, 45 of FIGS. 1 and 2. In so far as the features concerning the cooling contact pieces in the embodiment according to FIGS. 1 and 2, are likewise present in the embodiment according to FIGS. 5 and 6, reference is made to the above description.

An advantage of the present embodiment is, that between the heated, respectively softened partial regions 6, 16, 26, 36 and the cooled partial region 46 only a small transition area is formed. This is achieved in such a way, that the electrodes 4, 5; 14, 15; 24, 25; 35, 36 and the cooling contact pieces 44, 45 are spatially adjoining each other.

FIGS. 7 to 10, which are described jointly below, show a device according to a further embodiment. This largely corresponds in its design and function to that of FIGS. 1 and 2, so that concerning the commonalities reference is made the above description. In this case, the same or corresponding features are provided with the same reference numerals as in FIGS. 1 and 2.

A special feature of the present embodiment is that the contact pieces 4, 5 of the first pair are arranged in a transversal direction of the component 3 opposite to each other, i.e., only in the edge portions of the component 3. A current flowing between the negative form electrodes 4, 4' and the positive form electrodes 5, 5' heats the component 3 across its width between the negative and positive form electrodes. As a whole, a softened first partial region 6, shown in FIG. 10 and represented hatched, is achieved.

Adjacent to the contact pieces 4, 4'; 5, 5' of the first pair, second pairs of contact pieces 44, 45; 54, 55 are arranged, one of which (44, 45) is shown in a cross-sectional view in FIG. 9. The contact pieces of the second pairs are respectively formed as cooling contact pieces. The cooling contact pieces 44, 45; 54, 55 are shown schematically in FIG. 7. The cooling zones 46, 56, which are produced by the cooling contact pieces 44, 45; 54, 55, are shown schematically in FIG. 10. Between the cooling zones 46, 56, the soft zone 6, extending in transversal direction of the component 3, is arranged, which is also referred to as softened partial region.

In FIG. 9 it can be seen that the second pairs have, respectively, a lower contact piece 45 and an upper contact piece 44, which concerning their shape are adapted to the respective geometry of the component 3. The second pairs of contact pieces 44, 45; 54, 55 correspond concerning design and function to the embodiment shown in FIGS. 1 and 2, so that for abbreviation it is referred to the above description. The second pairs are arranged directly neighbouring the first pair during the post-processing, so that the configuration shown in FIG. 10 is achieved with the cooling zones 46, 56 and the soft zone 6 of the component 3 arranged therebetween. Between the cooling zones 46, 56 and the soft zone 6, only a small transition area is formed.

The component 3, which is the lower part of a B-column for a motor vehicle, can have a constant sheet thickness across the length and width, or can have a varying sheet thickness across the length and/or width. This can, for example, be achieved by means of flexible rolling of the strip material used as starting material. For a constant heating and constant softening, respectively, it is advantageous when the first pair of contact pieces 4, 4', 5, 5' is arranged in an area of constant sheet thickness. This would be, in the present embodiment, the partial region 6.

A method according to the invention for post-treating a formed and hardened component made of a metallic material can comprise the following steps.

In a first method step, a to be heated first partial region of the hardened component is brought into contact with the contact pieces of the first pair. At the same time or subsequent thereto the contact pieces of a second pair are brought into contact with a second partial region of the component. Subsequently, the first partial region of the component is heated to a first temperature T1 such that electric current is transmitted through the component by the first pair of contact pieces. Preferably, the first partial region is heated to a first temperature of at least 500° C., especially at least 700° C., at a preferred heating time of at least 30 seconds.

During the heating of the first partial region, a second partial region, which is especially arranged adjacent the first partial region, is set to a second temperature T2 by means of one or more second pairs of contact pieces, i.e., heated or cooled. In this case, the temperature setting of the second partial region of the component is carried out, at least with respect to one parameter influencing the temperature of the second region, independently of heating the first partial region. In an embodiment in which the second pair of contact pieces is formed as form electrodes for resistance heating, the temperature setting (heating) can be carried out by selecting a different current exposure time and/or other amperage, respectively electric current than in the first pair. In an embodiment in which the second pair of contact pieces is formed as cooling elements, the temperature setting (cooling) can be carried out by controlling the flow and/or the temperature of the cooling medium.

The described method can be carried out with any one of the devices of electric resistance heating according to one of FIGS. 1 to 10, which have at least one first pair of contact pieces 4, 5 and a second pair of contact pieces 44, 45.

The above described method for post-processing the hardened component for producing softened partial regions, respectively soft zones, can for example be preceded by the following method steps: flexible rolling of strip material, cutting a blank from the flexible rolled strip material, wherein the blank has a varying thickness across the length, hot-forming of a blank to a component, complete hardening of the component, cleaning the component and/or scaling of the component.

An advantage of the device according to the invention and method is that the component 3, hardened beforehand, can be softened in a targeted manner in partial regions 6, 16, 26, 36, to achieve a higher ductility in said partial areas. By using several pairs of contact pieces, the ductility of the component can be adapted in different partial regions to the individual requirements, or the contact pieces themselves can be adapted to different requirements concerning the geometry of the component.

The invention claimed is:

1. A method for post-treating a formed and hardened component made of a metallic material by a device for electric resistance heating, the device having at least one first pair of contact pieces and at least one second pair of contact pieces, the method comprising:

contacting the contact pieces of the first pair with a to be heated first partial region of the component such that the to be heated first partial region is arranged between the first pair of contact pieces in a thickness direction of the component;

contacting the contact pieces of the second pair with a second partial region of the component such that the second partial region is arranged between the second pair of contact pieces in the thickness direction of the component;

heating the first partial region of the component to a first temperature (T1) by conducting electric current through the component using the first pair of contact pieces, wherein the first partial region is heated to the first temperature (T1) of at most of 900° C., and setting the second partial region of the component to a second temperature (T2) using the second pair of contact pieces, wherein the second temperature (T2) is set independently of the first temperature (T1), so that the first partial region obtains a higher ductility than the second partial region;

wherein the formed and hardened component is produced by:

flexible rolling of a strip material;

cutting a blank from the strip material, wherein the blank has a varying thickness across the length; and hot-forming and hardening the blank.

2. The method of claim 1, wherein the step of heating the first partial region of the component further comprises at least one of the following:

the first partial region is heated to the first temperature (T1) of at least 500° C.; and the first partial region is heated for a period of at least 30 seconds.

3. The method of claim 1, wherein the step of contacting comprises at least one of the following:

that an upper contact piece of the first pair and an upper contact piece of the second pair are brought into contact with the component at a same time, that a lower contact piece of the first pair and a lower contact piece of the second pair are brought into contact with the component at a same time.

4. The method of claim 1, wherein the first pair of contact pieces and the second pair of contact pieces are configured to be individually controlled with respect to at least one parameter influencing the degree of heating.

5. The method of claim 1, wherein the step of setting the second partial region of the component to the second temperature (T2) is a heating process that is achieved by conducting electric current from one of the second pair of contact pieces through the component to another one of the second pair of contact pieces.

6. The method of claim 5, wherein heating the first partial region and the second partial region of the component comprises at least one of the following:

conducting electric current between the first pair of contact pieces and the second pair of contact pieces through the component with a timely offset, conducting electric current between the first pair of contact pieces and the second pair of contact pieces through the component with at least a partial timely overlap, and conducting electric current between the first pair of contact pieces and the second pair of contact pieces through the component with different electric currents.

7. The method of claim 1, wherein the step of setting the second partial region of the component to a second temperature (T2) is a cooling process that is achieved by cooling the contact pieces of the second pair.

8. The method of claim 1, wherein the first pair of contact pieces and the second pair of contact pieces are arranged directly next to each other and are brought into contact with the component directly next to each other.

9. The method of claim 1, further comprising at least one of the following steps before the post-treating:

cleaning of the component; and scaling the component.

10. The method of claim 1, wherein at least one of the contact pieces of the first pair of contact pieces are arranged such that the to be heated first partial region of the component is arranged between the contact pieces of the first pair of contact pieces in a thickness direction of the component, and the contact pieces of the second pair of contact pieces are arranged such that the second partial region of the component is arranged between the contact pieces of the second pair of contact pieces in a thickness direction of the component.

11. A method for producing a component made of a metallic material, comprising:

providing a blank made of metallic material;

forming and hardening the blank so as to obtain a formed and hardened component that has a greater hardness than the blank; and post-treating the formed and hardened component by a device for electric resistance heating that has at least one first pair of contact pieces and at least one second pair of contact pieces, the post-treating comprising:

contacting the contact pieces of the first pair with a to be heated first partial region of the component such that the to be heated first partial region is arranged between the first pair of contact pieces in a thickness direction of the component;

contacting the contact pieces of the second pair with a second partial region of the component such that the second partial region is arranged between the second pair of contact pieces in the thickness direction of the component; and heating the first partial region of the component to a first temperature (T1) by conducting electric current through the component by the first pair of contact pieces, and setting the second partial region of the component to a second temperature (T2) by the second pair of contact pieces, wherein the second temperature (T2) is set independently of the first temperature (T1) such that the first partial region of the component obtains a higher ductility than the second partial region.

* * * * *